US009834424B2

(12) United States Patent
Samson

(10) Patent No.: US 9,834,424 B2
(45) Date of Patent: Dec. 5, 2017

(54) TAPPING DEVICE FOR A BAG-IN-BOX PACKAGE AND ACTUATING APPARATUS AND CARTRIDGE THEREFOR

(71) Applicant: SQUELL PRODUKTION UND HANDEL GMBH, Hockenheim (DE)

(72) Inventor: Rainer Samson, Munster (DE)

(73) Assignee: Squell Produktion Und Handel GMBH, Hockenheim (DE)

( * ) Notice: Subject to any disclaimer, the term of this patent is extended or adjusted under 35 U.S.C. 154(b) by 33 days.

(21) Appl. No.: 14/916,833

(22) PCT Filed: Sep. 5, 2013

(86) PCT No.: PCT/DE2013/000501
§ 371 (c)(1),
(2) Date: Mar. 4, 2016

(87) PCT Pub. No.: WO2015/032372
PCT Pub. Date: Mar. 12, 2015

(65) Prior Publication Data

US 2016/0194186 A1 Jul. 7, 2016

(51) Int. Cl.

| | |
|---|---|
| ***B67B 7/00*** | (2006.01) |
| ***B67D 3/00*** | (2006.01) |
| ***B67D 3/04*** | (2006.01) |

(52) U.S. Cl.
CPC ..... *B67B 7/26* (2013.01); *B67D 3/0029* (2013.01); *B67D 3/0058* (2013.01); *B67D 3/04* (2013.01)

(58) Field of Classification Search
CPC ..... B67B 7/26; B67D 3/0029; B67D 3/0058; B67D 3/04
See application file for complete search history.

(56) References Cited

U.S. PATENT DOCUMENTS

| | | | | |
|---|---|---|---|---|
| 477,463 | A | 6/1892 | Schier | |
| 7,347,344 | B2 * | 3/2008 | Engels | B01F 13/1058 222/1 |

(Continued)

FOREIGN PATENT DOCUMENTS

| | | |
|---|---|---|
| EP | 0581492 A1 | 2/1994 |
| EP | 1201601 A1 | 5/2002 |

(Continued)

*Primary Examiner* — Frederick C Nicolas
*Assistant Examiner* — Bob Zadeh
(74) *Attorney, Agent, or Firm* — Muncy, Geissler, Olds & Lowe, P.C.

(57) ABSTRACT

The invention relates to a tapping device for at least one bag-in-carton package equipped with a tapping valve. The tapping device has a housing for receiving the bag-in-carton package and an actuating unit which corresponds with the tapping valve and which has a valve-receiving bearing and at least one actuating portion for actuating the tapping valve. The actuating portion is articulated on the valve-receiving bearing by a pivot pin, has an upwardly directed lever arm and is arranged completely within the housing. Upstream of a contact region which is situated above the pivot pin on the lever arm there is arranged an actuating portion which engages through the housing and acts on the lever arm in the contact region in order to actuate the tapping valve by way of the actuating portion and can be actuated manually from outside the housing. The invention further relates to the actuating unit and to a cassette for the tapping device.

17 Claims, 5 Drawing Sheets

(56) References Cited

U.S. PATENT DOCUMENTS

| | | | | |
|---|---|---|---|---|
| 2008/0156827 | A1* | 7/2008 | Alberto Rodrigues Anjos | B65D 77/061 222/105 |
| 2010/0133298 | A1* | 6/2010 | Samson | B67D 1/0857 222/146.6 |
| 2013/0213493 | A1* | 8/2013 | Samson | B65D 77/067 137/315.01 |
| 2016/0194186 | A1* | 7/2016 | Samson | B67D 3/0029 222/81 |
| 2016/0289059 | A1* | 10/2016 | Nelson | G01G 19/52 |

FOREIGN PATENT DOCUMENTS

| | | | |
|---|---|---|---|
| EP | 1926173 | A1 | 8/2007 |
| WO | WO 2012/041271 | A2 | 4/2012 |

* cited by examiner

TAPPING DEVICE FOR A BAG-IN-BOX PACKAGE AND ACTUATING APPARATUS AND CARTRIDGE THEREFOR

BACKGROUND OF THE INVENTION

Field of the Invention

The invention relates to a tapping device for at least one bag-in-box package according to the preamble of claim 1 and an actuating apparatus and cartridge therefor. The bag-in-box package is used for accommodating a beverage, such as juice or wine and has a tapping valve for tapping the beverage located in the bag, which tapping valve can be actuated vertically. The bag is emptied during tapping, without air flowing back into the bag, which means that the beverage located in the bag does not come into contact with oxygen, even after the bag-in-box package is opened, and therefore has a long shelf life.

Brief Discussion of the Related Art

A generic tapping device is known from WO 2012 041271 A2. This known tapping device has an actuating apparatus with a valve-mounting bearing and an actuating means for actuating the tapping valve. The actuating means is linked on the valve-mounting bearing by means of a horizontal pivot axis and has an upwardly directed lever arm. The lever arm is arranged outside of the housing and can therefore be actuated manually in the essentially horizontal direction for tapping. The horizontal actuation is converted via the pivot axis into a vertical actuation of the tapping valve from above. In this case, depending on the configuration of the tapping valve, either the tapping valve is pressed down, so that wings, which protrude laterally on the tapping valve and rest on the valve-mounting bearing, are moved upwards relatively to the tapping valve to actuate the tapping valve. In a different configuration of the tapping valve, the tapping valve fixedly bears on the valve-mounting bearing by way of laterally-protruding wings and actuation takes place by pressing from above on an actuating region on the tapping valve provided for that.

The housing of this known tapping device is constructed to be thermally insulating. Within the housing, a cooling of the bag-in-box package, and therefore of the beverage located therein, takes place. However, the thermal insulation of the housing is adversely influenced here by the lever arm of the actuating means arranged in a door of the housing.

SUMMARY OF THE INVENTION

The invention is based on the object of providing a tapping apparatus, which is convenient to use and in particular additionally enables an advantageous thermal insulation of the housing.

The invention achieves this object with a tapping device according to claim 1. In the case of a tapping device for at least one bag-in-box package equipped with an in particular vertically actuatable tapping valve, having a housing for accommodating the bag-in-box package and having an actuating apparatus corresponding with the tapping valve, which actuating apparatus has at least one valve-mounting bearing and which actuating apparatus has at least one actuating means for actuating the tapping valve, wherein the actuating means is linked by means of an, in particular horizontal, pivot axis on the valve-mounting bearing and has an upwardly directed lever arm, it is provided that the actuating means is arranged completely inside the housing. It is furthermore provided that an actuating element, which can be actuated from outside the housing, is arranged upstream of a contact region, which is located above the pivot axis on the lever arm. The actuating element reaches through the housing and acts by means of the actuating means in the contact region, particularly horizontally, on the lever arm to actuate the tapping valve. Protection is further claimed for the actuating apparatus of the tapping device according to the invention and for a cartridge for accommodating the bag-in-box package.

The actuating means can be operated conveniently from outside the housing by means of the actuating element, which for example has a push-button therefor. The contact element preferably reaches through the housing horizontally or perpendicularly to the outflow direction out of the tapping valve and acts on the lever arm horizontally or perpendicularly to the outflow direction out of the tapping valve. Due to the pivot axis, which is preferably orientated horizontally, the horizontal pressing movement is converted to a pressing movement from above onto the tapping valve.

The actuating element is arranged above a beverage outlet of the tapping valve, so that, unhindered by the actuating element, a cup can be positioned under the tapping valve and the button located thereabove can intuitively be pressed for tapping. During tapping, the beverage flows through an outlet arranged at the bottom on the tapping valve and through an opening in the housing. Preferably, neither the outlet nor the beverage stream emerging from the outlet touches the rim of the opening. The beverage can therefore flow directly out of the tapping valve into a cup or into a different container. A cleaning requirement for otherwise interposed lines is therefore dispensed with.

Due to the arrangement of the actuating means completely inside the housing, only a comparatively small opening has to be provided in the housing for the actuating means for actuating the tapping valve. A better insulation effect is therefore achieved for the housing, which is preferably constructed in a thermally insulating manner.

In the present case, the arrangement of the actuating element upstream of the contact region is to be understood to mean an arrangement, in which the actuating element is displaced with respect to the contact region on the side of the tapping valve, at least in the horizontal direction of the bag-in-box package in the direction of the housing. In this case, the tapping device is observed in a tapping-ready, particularly horizontal, orientation and from a front side, at which the tapping valve can be actuated by means of the actuating element. All further details, which relate to an arrangement of a part upstream or downstream of a different part, are based on a corresponding observation.

Preferably, the valve-mounting bearing has bearing faces for laterally projecting wings of the tapping valve. In a first type of the tapping valve, the wings are used to trigger the tapping procedure by lifting the wings with respect to a valve body of the tapping valve. A known tapping valve of the first type is known under the name "Vitop" tapping valve. According to a first embodiment of the actuating means, the invention is adapted to the tapping valve of the first type, that is to say to the "Vitop" tapping valve or tapping valves of similar construction. According to a second embodiment of the actuating means, the actuating means is adapted to a tapping valve of a second type, in which the wings are fixedly connected to the housing body of the tapping valve and are only used for support. A tapping valve of the second type is known as a "Rapak" tapping valve. Any tapping valves of similar construction can also be actuated by the tapping device according to the invention, however.

The actuating means is preferably constructed for actuating the tapping valve by pressing from above onto certain regions of the tapping valve. In the case of a tapping valve of the first type, the entire housing body is pressed downwards, so that the wings supported on the valve-mounting bearing perform a relative movement upwards and open the tapping valve as a result. In this case, the tapping valve is preferably guided in guide channels of the valve-mounting bearing. By contrast, in the case of the second type of tapping valve, the tapping valve is opened by pressing on an upper central region, wherein the valve body, which is fixedly connected to the wings, retains its position unchanged.

Preferably, the pivot axis is arranged in the horizontal direction or in a direction perpendicular to the outflow direction out of the tapping valve upstream of a projection of the tapping valve onto a projection plane which is horizontal or arranged perpendicularly to the outflow direction, when the actuating means is in contact with the tapping valve. As a result, horizontal pressing against the lever arm is converted into a pressing from above onto the certain regions of the tapping valve.

According to a preferred embodiment, the pivot axis is arranged in the horizontal direction or in a direction perpendicular to the outflow direction out of the tapping valve upstream of a projection of the contact region onto a projection plane which is horizontal or arranged perpendicularly to the outflow direction, when the actuating means is in contact with the tapping valve. As a result, an advantageous lever action is achieved and a stabilisation of the actuating means is becomes possible if the actuating means is guided in the rear region.

According to an advantageous embodiment, the contact element is displaceably held on the lever arm, particularly by means of at least one retaining groove. Preferably, the actuating means has an actuating section, which is linked at its front end on the valve-mounting bearing by means of the pivot axis and, starting from the rear end thereof, the lever arm extends upwards when the actuating means is in contact with the tapping valve by means of the actuating section. The actuating means is therefore constructed in the manner of an angled body with the essentially arranged actuating section and the essentially vertically or upwardly arranged lever arm.

According to a particularly preferred embodiment, the actuating means has a contact element, which is held adjustably on the lever arm, for providing the contact region. The contact element can assume an operating position, in which the actuating apparatus can be actuated by means of the actuating element, and can assume a locked position, in which the actuating apparatus is locked against actuation by means of the actuating means. As a result, it is possible to set whether tapping is possible or not by means of the actuating element. The provision of a beverage can therefore be temporally limited, in that the contact element is brought from the operating position into the locked position. Because the actuating means is arranged completely inside the housing, the contact element cannot be brought from the locked position into the operating position in an authorised manner. Unauthorised access to the interior of the housing is preferably prevented by means of a lock, by means of which an access door of the housing can be locked against opening.

According to a particularly preferred embodiment, the lever arm has an opening, through which the actuating element engages when the actuating means is in contact with the tapping valve and the contact element is in the locked position and the actuating element is actuated. The actuating element therefore reaches into empty space when actuated, so that the actuating means cannot be actuated.

According to an advantageous embodiment, the contact element is displaceably held on the lever arm, particularly by means of at least one retaining groove. Preferably, the lever arm has at least one retaining groove, in which the contact element is displaceably held. In particular, two retaining grooves are provided on the lever arm. The displaceability of the contact element constitutes an advantageous option to release or to lock the opening of the lever arm in a simple manner and to hold the contact element securely at the same time.

According to a preferred embodiment, the actuating means has at least one guide element on the lever arm. According to this embodiment, the valve-mounting bearing has at least one guide groove, which provides a lateral guide for the guide element when actuating the tapping valve by means of the actuating apparatus. Preferably, two guide elements and two guide grooves are provided. Due to the guide element guided in the guide groove, the actuating means is securely guided during actuation by means of the actuating element, so that bending or tilting of the actuating means is counteracted.

Particularly preferably, the actuating apparatus has a clip connection, holding the guide element in the guide groove and preferably engaging in an audible manner, for arresting the tapping valve on the actuating apparatus. The tapping valve can in this manner be clamped into the actuating apparatus in a tool-less and secure manner. The guide element audibly engages into the guide groove and cannot subsequently automatically leave its guide. To release the clip connection, it is sufficient to press the guide element or the guide elements with a little force outlay in the direction of the axis of rotation, in order to be able to bend down the actuating means with respect to the valve-mounting bearing.

According to an advantageous embodiment, the actuating element has a tappet mounted displaceably in the housing along the longitudinal axis thereof. This gives a robust transmission of an actuation, by pressing against the actuating element, from outside the housing into the housing interior. Furthermore, there is therefore no or at most a slight gap present, through which a heat exchange between the housing interior and the surroundings of the housing could take place.

According to an advantageous embodiment, the actuating element has, at its end which can be contacted in the contact region by way of the actuating means, a setting screw for setting the length of the actuating element. In particular, the tip of the tappet is formed by the setting screw, the axis of rotation of which runs in the longitudinal direction of the tappet. Due to the setting screw, it is possible in a simple manner and precisely to set how far the actuating element has to be actuated to trigger a tapping procedure.

Preferably, the actuating element has a return spring, so that after an actuating procedure of the actuating element, the tapping valve can close without having to actively push the actuating element back to its initial position.

The actuating apparatus is preferably fastened on a holder. The holder is preferably a separate component with respect to the actuating apparatus. Alternatively, the holder is constructed in one piece with the actuating apparatus.

According to a preferred embodiment, the actuating apparatus is constructed as a replaceable insert, which is adapted to the respective tapping valve. In particular, the actuating apparatus is releasably fastened on the separate holder. The respective insert is specifically adapted to the first type or the second type of the tapping valve or a different type of the tapping valve. The tapping device is suitable for tapping liquids out of bag-in-box packages with differently constructed tapping valves, due to the option of changing the actuating apparatus. To change to a bag-in-box package with a tapping valve of a different type, it is only necessary to replace the actuating apparatus. The actuating apparatus preferably consists of the valve-mounting bearing, the actuating means and the pivot axis. The pivot axis is either constructed concretely as a separate component or results due to a special configuration of the valve-mounting bearing and/or the actuating means.

The holder preferably has a front contact area, against which the replaceable actuating apparatus, particularly the valve-mounting bearing can be supported. The contact area is orientated vertically in particular. Due to the contact area, the valve-mounting bearing is secured against an, in particular horizontal, displacement relatively to the holder, even in the case of actuation by means of the actuating means.

According to an advantageous embodiment, the holder is linked on a fixed part such that it can be folded down, particularly for changing the bag-in-box package. Preferably, the holder is arrested in its folded-up position on the fixed part by means of a hook. For folding down, the holder is lifted and then folded down forwards.

The fixed part is preferably fixedly positioned in the housing, for example by means of a screw connection. In particular, the fixed part is fastened on a shelf, on which the bag-in-box package rests in a state ready for tapping.

According to an alternative embodiment to the design which can be folded down, the holder is fastened on a cartridge for accommodating the bag-in-box package. The cartridge is preferably suitable for accommodating different, particularly differently sized, bag-in-box packages. The respective bag-in-box package can be inserted into the cartridge outside of the housing. Even the actuating apparatus can already be positioned ready for tapping at the tapping valve. A door in the housing therefore only needs to be opened for a short time again for inserting the cartridge, so that insertion of the cartridge or changing cartridges is possible in a short time. Preferably, the holder is in this case constructed for hanging in the fixed part.

BRIEF DESCRIPTION OF THE DRAWINGS

Further embodiments result from the claims and also from the exemplary embodiments, which are explained on the basis of the attached drawings. In the drawings:

DETAILED DESCRIPTION OF THE PREFERRED EMBODIMENTS

Figure 1:
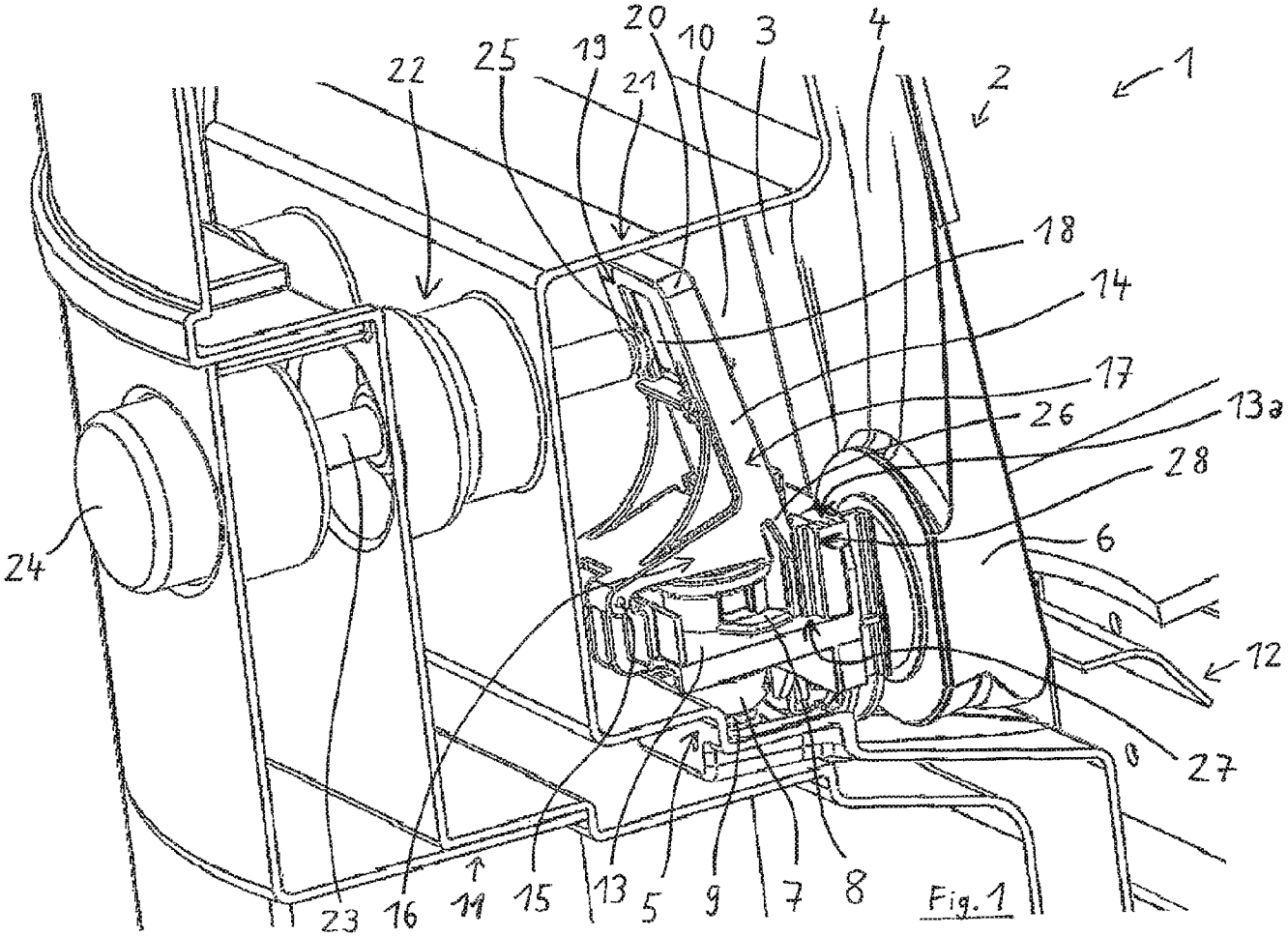
FIG. 1: shows a cutaway section of a tapping device according to the invention according to an exemplary embodiment of the invention in a perspective illustration.

FIG. 1 shows a tapping device 1 for a bag-in-box package 2, which has a box 3, a bag 4 held in the box 3 and a tapping valve 5, connected to the bag 4, for tapping liquid 6 out of the bag 4 or out of the bag-in-box package 2. The tapping valve 5 has a base body 7 and laterally projecting wings 8, which must be moved upwards relatively to the base body 7 in the exemplary embodiment shown, in order to allow a part of the liquid 6 to flow out through an outlet 9 of the tapping valve 5. Here, the tapping valve 5 is what is known as a "Vitop" tapping valve or a tapping valve of similar construction. Alternatively to the exemplary embodiment shown, the bag-in-box package 2 can however also have what is known as a "Rapak" tapping valve or a tapping valve of similar construction, in which the wings 8 are fixedly connected to the base body 7 and in which a certain region must be pressed down with respect to the base body 7, in order to actuate the tapping valve.

Even the tapping valve 5 illustrated is actuated according to the invention by means of pressing on a certain region of the tapping valve 5. In this case, however, the entire base body 7 of the tapping valve 5 is pressed down with respect to the wings 8.

To actuate the tapping valve 5, the tapping device 1 has an actuating apparatus 10, which is arranged completely inside a housing 11, particularly behind a door of the housing 11. The housing 11 is constructed in a thermally insulating manner and likewise surrounds the bag-in-box packaging 2, which is cooled together with the liquid 6 located therein by means of a cooling device, which is not illustrated.

The tapping device 1 has a holder 12, on which the actuating apparatus 10 is fastened in a replaceable manner. In particular, the actuating apparatus 10 can therefore quickly be replaced with an actuating apparatus which is adapted to accommodate a "Rapak" tapping valve, for example. The holder 12 is a metal sheet for example.

The actuating apparatus 10 has a valve-mounting bearing 13, which is used as a support for the wings 8 and provides guide channels 13*a* for guiding the tapping valve. Furthermore, the actuating apparatus 10 has an actuating means 14 constructed in an angled manner and also a pivot axis 15, by means of which the actuating means 14 is pivotably linked upstream of the tapping valve 5. The pivot axis 15 preferably consists of metal, whereas the valve-mounting bearing 13, which is of one-piece construction and the actuating means 14 each consist of plastic.

The actuating means 14 has an actuating section 16 and a lever arm 17 arranged opposite the pivot axis 15 and directly upwards, and also a contact element 18 held displaceably on the lever arm 17. The contact element 18 is held displaceably in the retaining grooves 19 and illustrated in an operating position 20 in FIG. 1, in which the contact element 18 provides a contact region 21 for actuation by means of an actuating element 22. The actuating element 22 is arranged upstream of the contact region 21 in the region of the housing 11 and reaches through the housing 11 by way of a tappet 23. On the outer front side of the front side of the housing 11, the actuating element 22 has a push-button 24 with an internal return spring, which cannot be seen in the illustration according to FIG. 1. On the side opposite the push-button 24, the actuating element 22 has an adjusting screw 25 screwed into the tappet 23, by means of which adjusting screw 25 the length of the actuating element 22 and therefore the path, through which the push-button 24 must be pressed for actuating the tapping valve 5, can be set.

The actuating means 14 has guide elements 26, which are preferably constructed from plastic in one piece with the actuating section 16 and the lever arm 17. The valve-mounting bearing 13 has guide grooves 27 for guiding the guide elements 26. Furthermore, the guide elements 26 and the guide grooves 27 are constructed and arranged with respect to one another in such a manner that a clip connection 28 results, by means of which the guide elements 26 can engage in the guide grooves 27. In the illustration according to FIG. 1, the guide elements 26 are engaged in the guide grooves 27 so that the tapping valve 5 is securely held between the valve-mounting bearing 13 and the actuating means 14.

The push-button 24 is actuated for tapping liquid out of the bag-in-box package 2, so that the actuating element 22 is pressed against the contact element 18 using the setting screw 25. The horizontal movement of the actuating element 22 is converted into an essentially vertical movement by tipping the actuating means 14, by means of which vertical movement the actuating section 16 presses on certain regions of the tapping valve 5 and therefore actuates the tapping valve 5.

Figure 2:
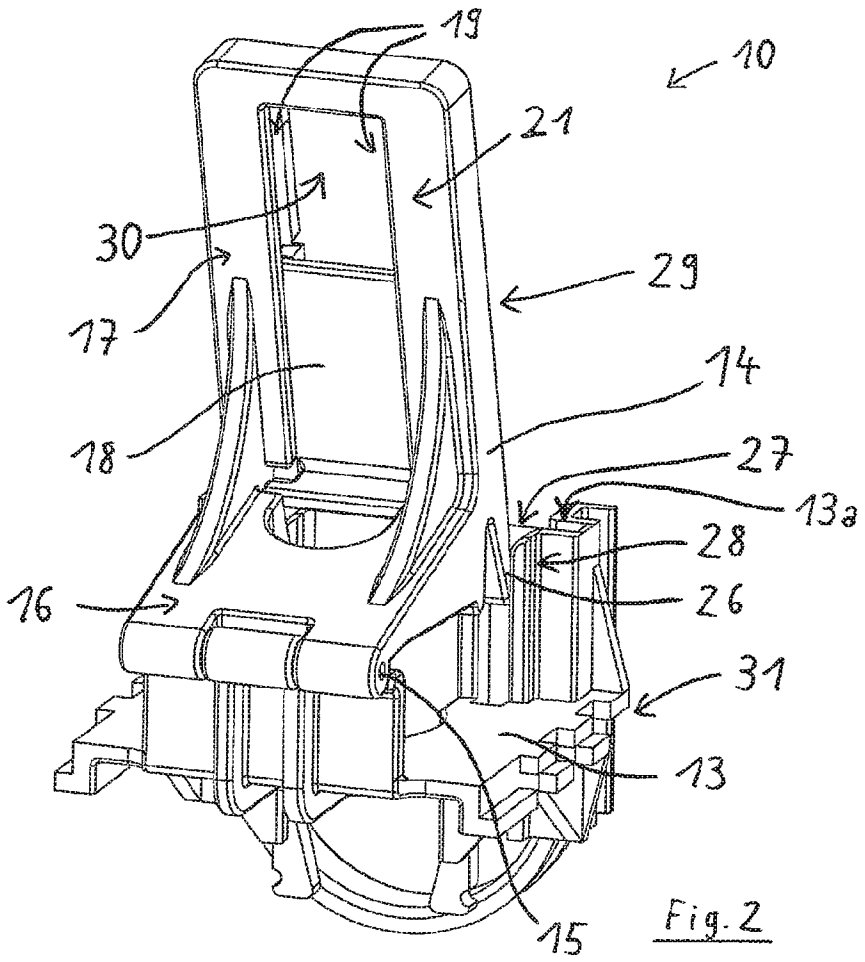
FIG. 2: shows the actuating apparatus of the tapping device of the exemplary embodiment of FIG. 1 in a perspective illustration.

The tapping device 1 can be locked against actuation by means of the actuating element 22 and therefore against an undesired tapping, in that the contact element 18 is displaced in the retaining grooves 19 into a locked position 29 illustrated in FIG. 2, in which locked position the lever arm 17 has an opening 30 in the contact region 21 and a contact of the actuating element 22 using the actuating means 14 is therefore not possible. When the actuating element 22 is actuated, the tappet 23 engages through the opening 30.

In FIG. 2, the actuating apparatus 10 is illustrated isolated from further parts of the tapping device 1. Identical reference numbers in the figures designate identical parts. The actuating apparatus 10 has projections 31, which are arranged in two rows above one another, in order to be able to engage around the holder 12 above and below for fastening the actuating apparatus 10 on the holder 12 and therefore to fix the fastening apparatus 10 in the vertical direction on the holder 12.

Figure 3:
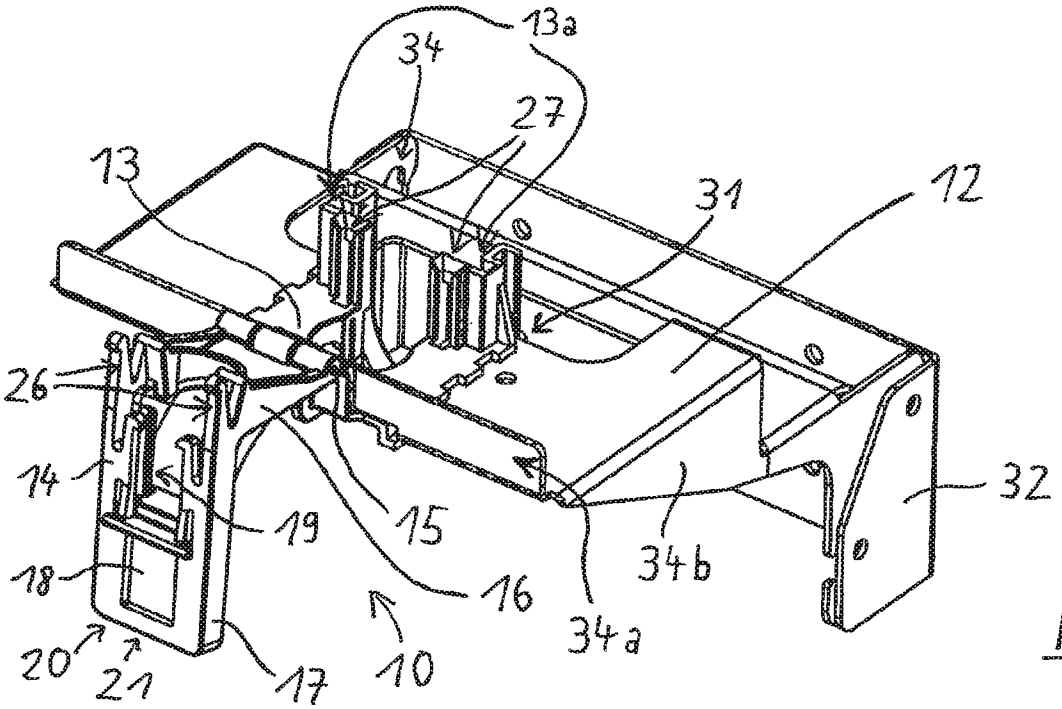
FIG. 3: shows a holder with the actuating apparatus of FIG. 2 fastened thereon in a perspective illustration.

FIG. 3 shows the actuating apparatus 10 correspondingly fixed on the holder 12, with actuating means 14 folded down with respect to the valve-mounting bearing 13, which actuating means is therefore not arrested on the valve-mounting bearing 13 by means of the clip connection 28. The holder 12 is linked on a fixed part 32 such that it can be folded down and secured against inadvertent folding down by means of a hook 34. To fold down the holder 12, the holder 12 must initially be lifted slightly, so that the hook 34 is released from the fixed part 32.

At the front end of the holder 12, the holder 12 has an upwardly directed or vertical contact area 34*a* for the valve-mounting bearing 13, which contact area 34*a* can absorb forces from the actuating apparatus 10. A front section of the valve-mounting bearing 13 leading to the pivot axis 15 bears against the contact area 34*a* in front of the contact area 34*a*. A laterally downwardly angled support surface 34*b* on each side of the holder 12 contributes to the torsional rigidity of the holder 12 in a tapping procedure or in the case of pressing from above onto the tapping valve 5. The tappet 23 can therefore be guided through the housing 11 with small tolerances, so that coldness losses are minimised by any holes in the housing 11.

Figure 4:
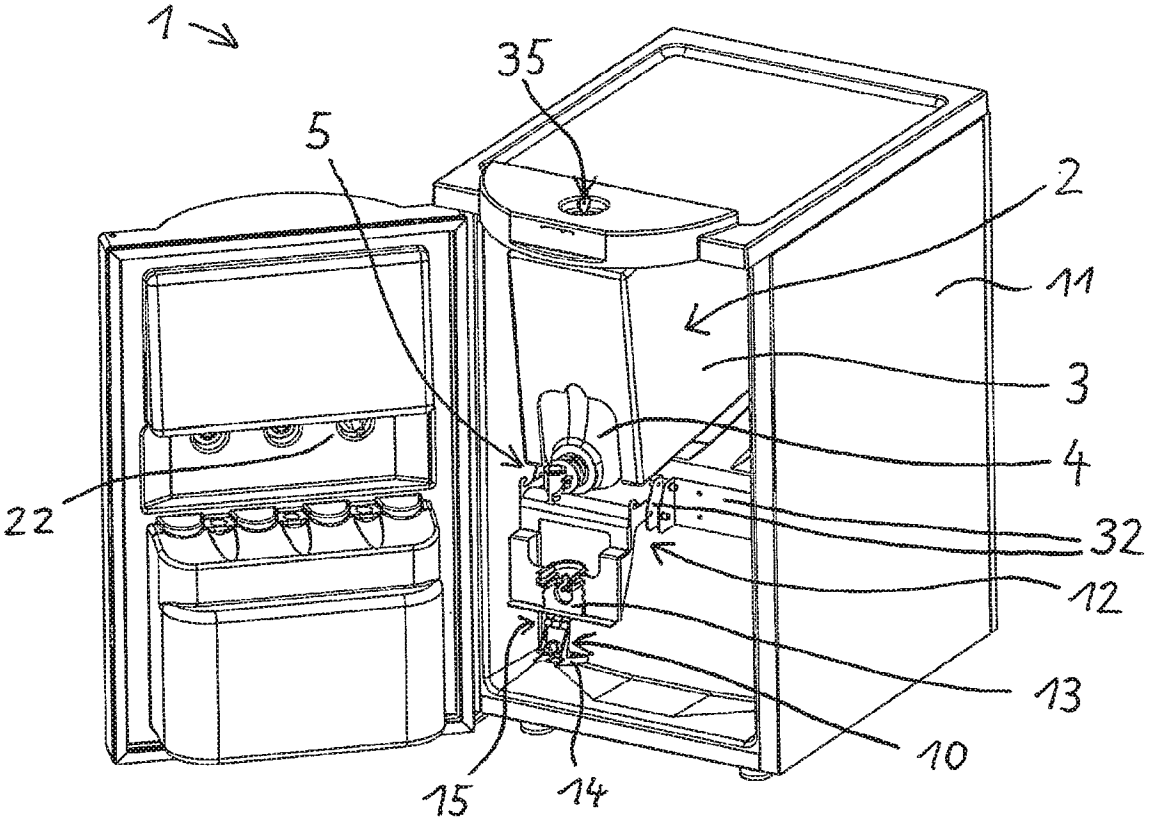
FIG. 4: shows the tapping device of the exemplary embodiment of FIG. 1 in a perspective illustration.

FIG. 4 shows the tapping device 1 with two fixed parts 32 mounted next to one another in the housing 11. The holder is linked on the left fixed part 32, but not hung by means of the hook 34, rather it is folded down. The bag-in-box package 2 is likewise arranged on the left side with a slight slope forwards in the housing 11. On the right next to the bag-in-box package 2, there is space for a further bag-in-box package, so that the tapping device 1 can provide two tapping points arranged next to one another. The tapping device 1 is furthermore equipped for a central arrangement of the bag-in-box package 2 and the associated tapping point. In particular, three corresponding openings for tappets of actuating elements are provided, for the three possible arrangements of the bag-in-box package 2, in the door of the housing 11. Thus, either a bag-in-box package with, in particular 20 liters filling volume, or up to two bag-in-box packages 2 with, in particular 10 liters filling volume, or up to three bag-in-box packages with, in particular 3 or 5 liters filling volume, can be arranged inside the housing 11 and assigned to a tapping point.

To change the bag-in-box package 2, the tapping device 1 is brought into the arrangement illustrated in FIG. 4. Subsequently, the holder 12 is folded up to the tapping valve 5 and possibly lifted slightly, in order to allow the hook 34 to engage on the fixed part 32 and therefore to fix the holder 12. Subsequently, the actuating means 14 is pivoted or folded down until the clip connection 27 engages. When the door is open, operating elements are furthermore accessible for setting the desired temperature inside the housing 11. A lock 35 is provided on the housing 11 to lock the closed door of the housing 11.

Figure 5:
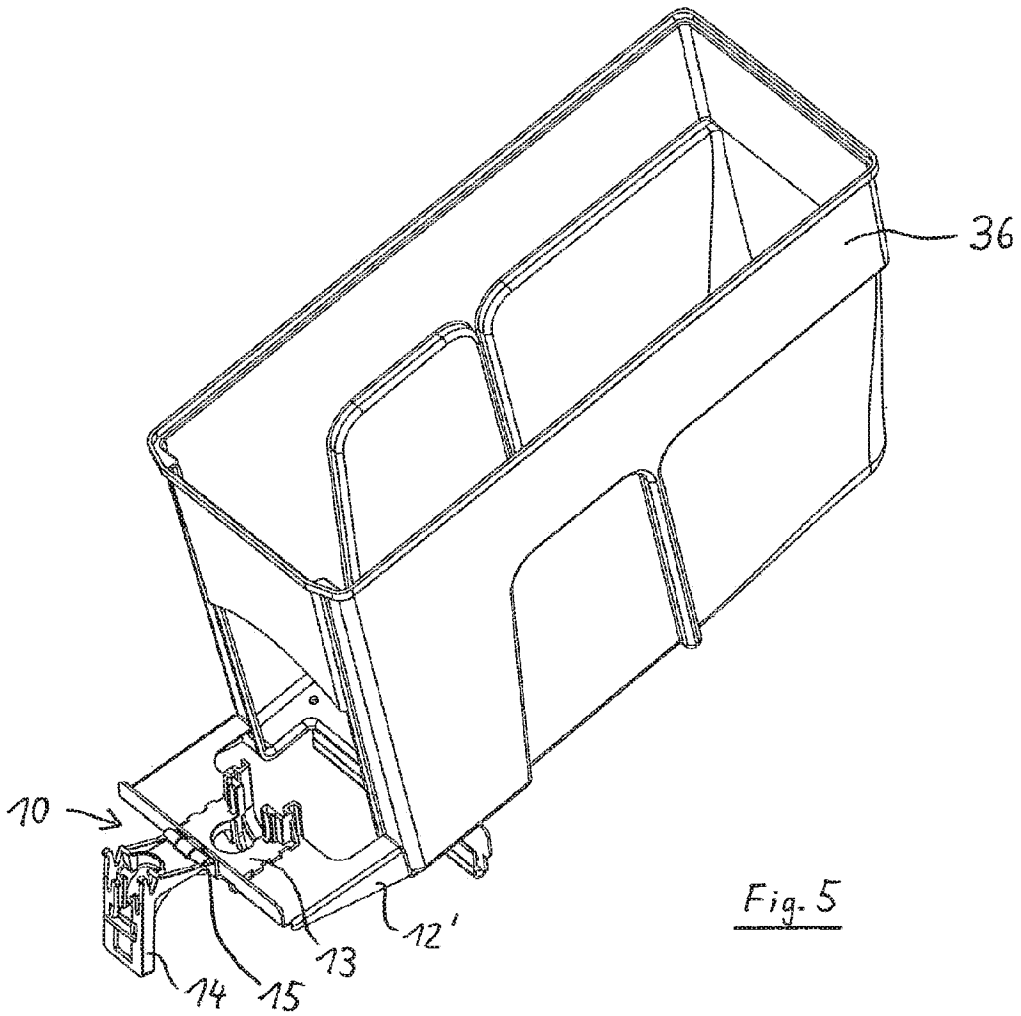
FIG. 5 shows a cartridge with the holder fastened thereon according to a further exemplary embodiment of the invention and the actuating apparatus of FIG. 2 held in the holder in a perspective illustration.

FIG. 5 shows a cartridge 36, which is suitable for accommodating differently sized bag-in-box packages, particularly for up to 3 or 5 or 10 or 20 liter filling volumes. A holder 12' is fixedly connected to the cartridge 36, which holder, in contrast with the holder 12 of FIGS. 1, 3 and 4, cannot be folded down, but otherwise resembles the holder 12. The actuating apparatus 10 is identically fastened on the holder 12', as described previously for the holder 12. In particular, the actuating apparatus 10 can be pulled off the holder 12' in a tool-less manner and replaced by a different actuating apparatus. The bag-in-box package 2 can be inserted into the cartridge 36 outside of the tapping device 1, wherein the tapping valve 5 is introduced from above into the guide channels 13*a* of the valve-mounting bearing 13. The final fixing of takes place by folding down the actuating means 14 until the clip connection 28 engages.

All of the features mentioned in the preceding description and in the claims can be combined in any desired selection with the features of the independent claim. The disclosure of the invention is therefore not limited to the described or claimed feature combinations, rather all sensible feature combinations in the context of the invention are to be considered as disclosed.

The invention claimed is:

1. A tapping device for at least one bag-in-box package equipped with a tapping valve, having a housing for accommodating the bag-in-box package and having an actuating apparatus corresponding with the tapping valve, the actuating apparatus has at least one valve-mounting bearing and the actuating apparatus has at least one actuating means for actuating the tapping valve, wherein the actuating means is linked by means of a pivot axis on the valve-mounting bearing and has an upwardly directed lever arm, wherein the actuating means is arranged completely inside the housing and in that an actuating element, which reaches through the housing and acts on the lever arm by means of the actuating means in a contact region for actuating the tapping valve and can be actuated manually from outside the housing, is arranged upstream of the contact region, which is located above the pivot axis on the lever arm.

2. The tapping device according to claim 1, wherein the pivot axis is arranged in a horizontal direction upstream of a projection of the contact region onto a horizontal projection plane, when the actuating means is in contact with the tapping valve.

3. The tapping device according to claim 1, wherein the actuating means has an actuating section, the actuating means linked at the front end of the actuating section on the valve-mounting bearing by means of the pivot axis and, starting from the rear end thereof, the lever arm extends upwards when the actuating means is in contact with the tapping valve by means of the actuating section.

4. The tapping device according to claim 1, wherein the actuating means has a contact element, which is held adjustably on the lever arm, for providing the contact region, the contact element can assume an operating position, in which the actuating apparatus can be actuated by means of the actuating element, and the contact element can assume a locked position, in which the actuating apparatus is locked against actuation by means of the actuating means.

5. The tapping device according to claim 4, wherein the lever arm has an opening, through which the actuating element engages when the actuating means is in contact with the tapping valve, the contact element is in the locked position and the actuating element is actuated.

6. The tapping device according to claim 4, wherein the lever arm has at least one retaining groove, in which the contact element is displaceably held.

7. The tapping device according to claim 1, wherein the actuating means has at least one guide element on the lever arm and in that the valve-mounting bearing has at least one guide groove, which provides a lateral guide for the guide element when actuating the tapping valve by means of the actuating apparatus.

8. The tapping device according to claim 7, wherein the actuating apparatus has a clip connection, holding the guide element in the guide groove, for arresting the tapping valve on the actuating apparatus.

9. The tapping device according to claim 1, wherein the actuating element has a tappet mounted displaceably in the housing along the longitudinal axis thereof.

10. The tapping device according to claim 1, wherein the actuating element has, at the end of the actuating element, which can be contacted in the contact region by way of the actuating means, a setting screw for setting the length of the actuating element.

11. The tapping device according to claim 1, wherein the actuating apparatus is fastened on a separate holder or is constructed in one piece with a holder.

12. The tapping device according to claim 11, wherein the actuating apparatus is constructed as a replaceable insert adapted to the respective tapping valve, the insert consists of the valve-mounting bearing, the actuating means and the pivot axis and is fastened releasably on the separate holder.

13. The tapping device according to claim 11, wherein the holder has a front contact area, against which the replaceable actuating apparatus can be supported.

14. The tapping device according to claim 11, wherein the holder is linked on a fixed part such that the holder can be folded down.

15. The tapping device according to claim 11, wherein the holder is fastened on a cartridge for accommodating the bag-in-box package.

16. The cartridge for accommodating the bag-in-box package with the holder for the tapping device according to claim 15 fastened thereon in combination with the actuating apparatus, where either a) the holder is constructed such that the actuating apparatus of the tapping device can be releasably fastened on the holder as a replaceable insert which is constructed separately from the holder, or b) the holder is constructed in one piece with the actuating apparatus.

17. The actuating apparatus for the tapping device according to claim 1, wherein the contact region for a manually actuated actuating element for actuating the tapping valve is located above the pivot axis on the lever arm and wherein the actuating means has an actuating section, the actuating means linked at a front end of the actuating section on the valve-mounting bearing by means of the pivot axis and, starting from a rear end thereof, the lever arm extends upwards when the actuating means is in contact with the tapping valve by means of the actuating section.

* * * * *